US006116621A

United States Patent [19]

Flater

[11] Patent Number: 6,116,621

[45] Date of Patent: Sep. 12, 2000

[54] ROLLER SKATE SWING BRAKE

[75] Inventor: Anders H. Flater, Highland Park, Ill.

[73] Assignee: Trans-Mex Corporation, Highland Park, Ill.

[21] Appl. No.: 09/438,934

[22] Filed: Nov. 12, 1999

Related U.S. Application Data

[63] Continuation-in-part of application No. 09/149,652, Sep. 8, 1998.

[51] Int. Cl.[7] ..... A63C 17/14

[52] U.S. Cl. ..... 280/11.212; 188/4 R; 188/5; 280/11.215; 280/11.206

[58] Field of Search ..... 188/4 R, 4 B, 188/55; 280/11.2, 11.212, 11.215, 11.206, 11.22

[56] References Cited

U.S. PATENT DOCUMENTS

| | | | |
|---|---|---|---|
| 5,374,070 | 12/1994 | Pellegrini, Jr. et al. | 280/11.2 |
| 5,435,579 | 7/1995 | Pozzobon | 280/11.2 |
| 5,486,012 | 1/1996 | Olivieri | 280/11.2 |
| 5,511,803 | 4/1996 | Klukos | 280/11.2 |
| 5,511,804 | 4/1996 | Pellegrini, Jr. et al. | 280/11.2 |
| 5,653,454 | 8/1997 | Chin | 280/11.2 |
| 5,664,794 | 9/1997 | Mitchell et al. | 280/11.2 |

*Primary Examiner*—Michael Mar

[57] ABSTRACT

A roller skate swing brake includes a support pivotably attached to the axle of the rear wheel of a skate and containing a brake pad. The support is spring activated to keep the brake pad from contacting the skating surface in the open position in front of the rear wheel, When braking is desired, the skater raises the front wheel of the skate, which action brings a roller, contained by a pivot member located back of the rear wheel, into contact with the skating surface. By linkage, the brake pad is swung down in front of the rear wheel where the movement of the skate and further pivoting of the pivot member will bring the brake pad to its full braking position underneath the rear wheel of the skate. At this point, the skater lowers the front wheel onto the skating surface so as to brake the skate while maintaining the wheels of both skates level on the skating surface. The braking force may be regulated by the shift of the skater's weight over the skate. The brake may be equally applied in a stationary stance by raising the front wheel to push the pivot member rearwards until the brake pad is swing into its full braking position underneath the rear wheel permitting the skater to stand resting on the brake pad. The brake pad returns to the open position when disengaged from the skating surface. The roller skate swing brake is intended to improve the safety and joy of roller skating by providing an effective and effortless braking mechanism.

11 Claims, 3 Drawing Sheets

22
3
10
18
4
11
1
2
26
19
27

20
22
3
18
4
1
2
11
27

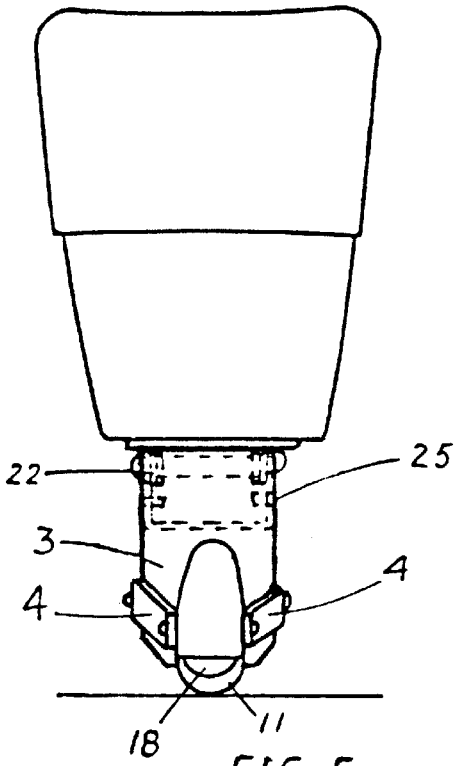
FIG. 3
FIG. 4
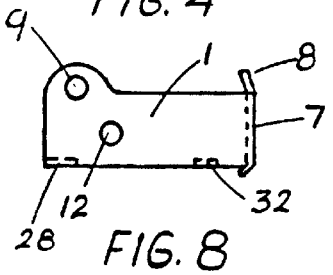
FIG. 5
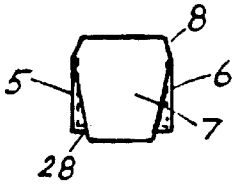
FIG. 6
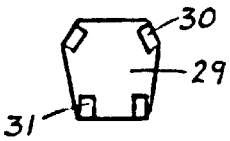
FIG. 7
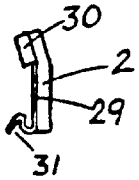
FIG. 8
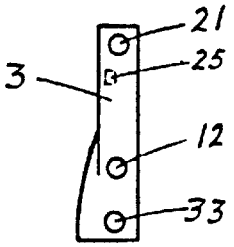
FIG. 9
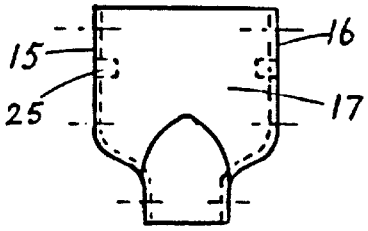
FIG. 10
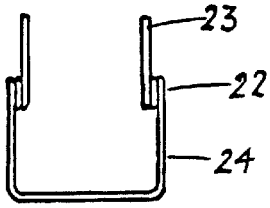
FIG. 11
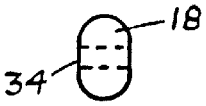
FIG. 12
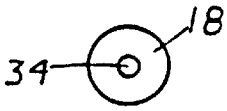
FIG. 13
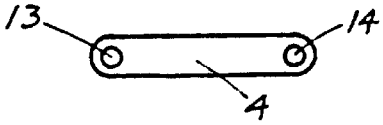

ROLLER SKATE SWING BRAKE

This application is a Continuation-In Part of prior application Ser. No. 09/149,652, filed Sep. 8, 1998, pending.

BACKGROUND OF THE INVENTION

The present invention relates, in general, to the braking of in-line roller skates and is intended to promote the safety and joy of roller skating.

The braking of "inline" roller skates is difficult to accomplish by movement of the skates alone and is presently generally carried out by the use of a fixed brake pad protruding from the rear of one pair of roller skate shoes and which pad is made to scrape against the skating surface to stop the movement of the skater. This procedure is accomplished as the skater leans back on one skate while positioning the heel of the other skate so that the brake pad may come into braking contact with the skating surface. The maneuver is inherently unstable and may cause the fall of the skater since it does not allow braking while the wheels of both skates are parallel and on the skating surface.

Thus it would be desireable to provide a roller skate brake which would provide effortless braking while the skate is held level with the skating surface and to utilize the weight of the skater to regulate the braking force for improved skater balance.

SUMMARY OF THE INVENTION

In the preferred embodiment of the invention, the roller skate swing brake includes a a pivot member containing a roller positioned behind the rear wheel of the skate and above the skating surface. The pivot member is connected to a support containing a brake pad. The support is pivotably connected to the axle of the rear wheel and swung into its open position in front of the rear wheel when the brake pad is disengaged from the skating surface. To activate the brake, the skater raises the front wheel of the skate, so as to bring the roller of the pivot member into contact with the skating surface which action will swing the pivot member rearwards. By linkage, the lower edge of the brake pad is then brought into contact with the skating surface whereby the forward motion of the skates and further pivoting of the pivot member will pivot the brake pad into its full braking position underneath the rear wheel. At the same time, the skater lowers the front wheel of the skate onto the skating surface thus allowing the braking force on the skating surface to be applied by the weight of the skater without required muscular clamping efforts. The brake pad can equally be applied when the skater is stationary by raising the front wheel so as to push the roller rearwards until the brake pad has reached its full braking position underneath the rear wheel at what point the skater lowers the front wheel to the skating surface. The brake returns to its open position when the rear wheel is lifted to disengage the brake pad from the skating surface.

The above and other objectives of the preferred embodiment of the invention are accomplished with a support pivotably connected to the axle of the rearmost wheel of a skate. A pair of holes from one arm of the support to the opposite point of the other arm is adapted to be mounted on the axle of the wheel so that the open end of the support faces toward the rear of the skate. The close end, containing a brake pad, points towards the front of the skate and is located in front of the rear wheel when the brake is in the open position. The support is attached by link members to a pivot member which is hinged to the rear end of the chassis behind the rear wheel whereby its lower end, containing a roller, is in close proximity to the skating surface. The pivot member is connected to a spring which is anchored in the chassis of the skate. By linkage, the tension of the spring forces the support arm into its open position over the skating surface against the chassis of the skate.

The brake pad, of high density material having a high coefficient of friction and durability, is held by the spring against the chassis of the skate in front of the rear wheel of the skate and in this open position will ride above the skating surface. The brake is activated when the skater raises the front end of the skate which action brings the roller, contained by the pivot member, into contact with the skating surface. The roller and pivot are thus pushed rearwards, against the tension of the spring, and which action, through link members, will swing the support and brake pad onto the skating surface. At this point, no further raising of the front wheel is generally required as the forward motion of the skate then swings the brake pad into its full braking position against the chassis underneath the rear wheel while the pivot member is swung into its extended rearward position. In this position, the brake pad extends underneath the rear wheel while the skater lowers the front wheel onto the skating surface to maintain level ground contact of both skates. The body weight of the skater thus exerts the braking force on the brake pad against the skating surface whereby the extent of braking may be regulated by shifting the weight of the skater from heel to toe of the skate. The brake pad will remain in its full braking position as long as the skater keeps the heel down to the point of maintaining a stationary braking stance. The skater deactivates the brake by lifting the heel of the skate so as to disengage the brake pad from the skating surface which action allows the spring to swing the brake pad up to its open position in front of the rear wheel and bring the roller, attached to the pivot member, back to its close position behind the rear wheel.

The brake pad material may be attached to the support by molding, bonding or bolt fasteners. In the preferred embodiment of the invention, the brake pad material is bonded or molded to a backing plate containing tabs and clips which permit the brake pad to be snapped on to the support and removed without required tools and bolts. In this way, the ease of applying the brake pad will accommodate the use of a variety of brake pad material best suited to different skating surfaces and indoor and outdoor activities.

The roller skate swing brake of this invention may be used on either skate (left or right) or both. When affixed to either skate, the swing brake can be finely activated to provide an effective braking area to the ground with an applied force substantially greater than that of current toe-raised or fixed brakes. At the same time, the skater's effort in applying the braking force is reduced to a minimum by using the body weight, rather than muscular clamping force, while the skate is firmly positioned on the skating surface. In this way, the swing brake allows the skater to shift the weight exerted on the brake pad so as to vary the braking force onto the ground and at the same time maintain effective skating balance. Additionally, the brake pads may be snapped on and off to provide easy replacement for best braking application on various skating surfaces.

In summary, the swing brake of this invention uses a pivotable brake pad to generate stopping force on the skating surface while the skate remains evenly on the ground, has an effective braking area in contact with the skating surface, applies the weight of the skater for effortless braking force, can be fitted to both skates, allows for easy brake pad replacement, has low weight and minimal protrusion. These and other advantages of the swing brake of this invention will become apparent in the remainder of this disclosure.

DESCRIPTION OF THE DRAWINGS

FIG. 3. is a rear elevational view of a skate with the swing brake of this invention in an open position.

FIG. 4 is a side view of a support of this invention.

FIG. 5 is a bottom view of a support of this invention.

FIG. 6 is a top view of a brake pad of this invention.

FIG. 7 is a side view of a brake pad of this invention.

FIG. 8 is a side view of a pivot member of this invention.

FIG. 9 is a rear view of a pivot member of this invention.

FIG. 10 is a top view of a spring of this invention.

FIG. 11 is a frontal view of a roller of this invention.

FIG. 12 is a side view of a roller of this invention.

FIG. 13 is a side view of a link member of this invention.

DETAILED DESCRIPTION OF THE INVENTION

Figure 1:
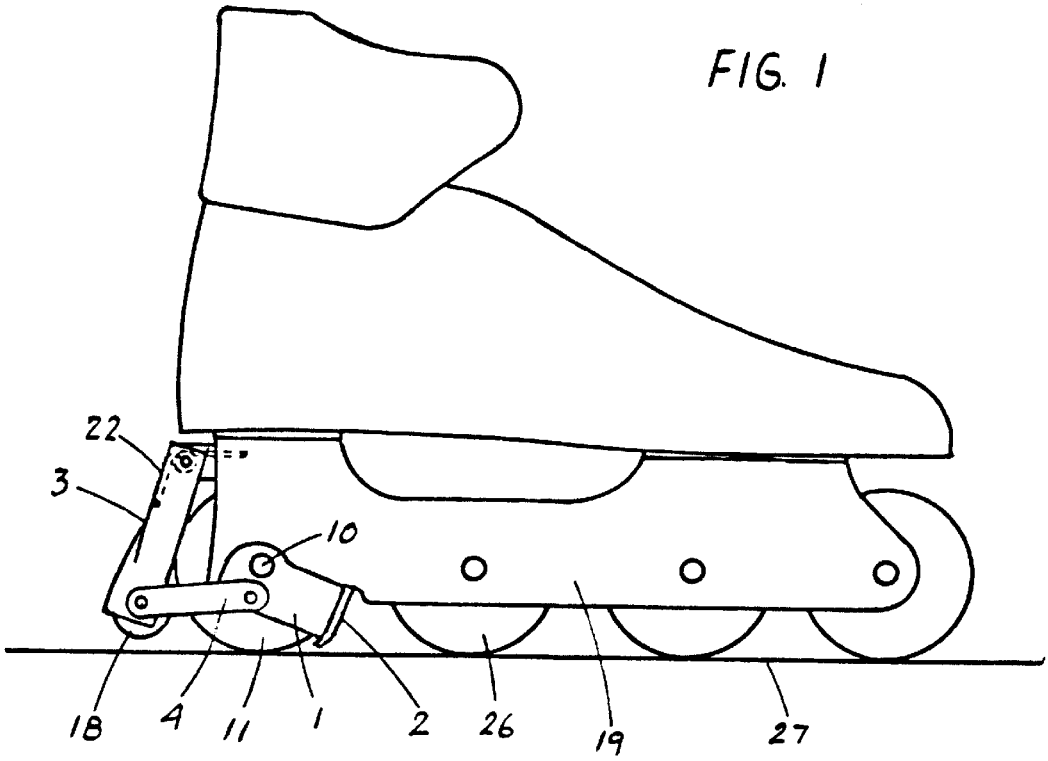
FIG. 1 is a side elevational view of a skate with the swing brake of this invention in an open position.
Figure 2:
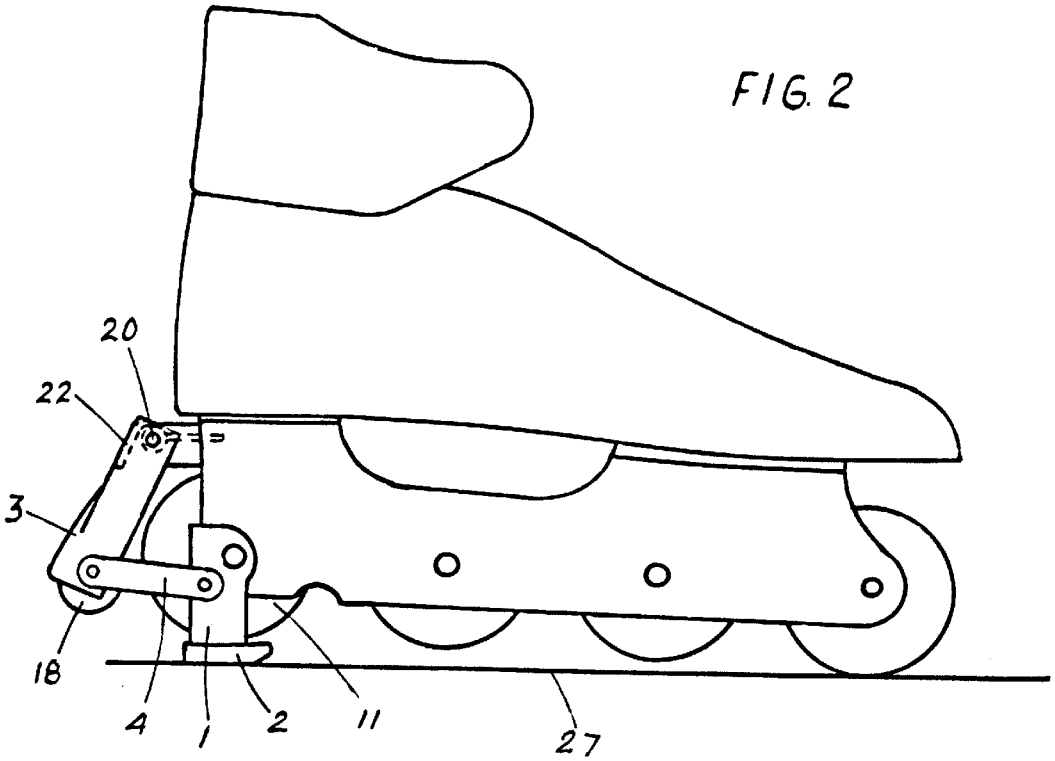
FIG. 2 is a side elevational view of a skate with the swing brake of this invention in a brake position.

With reference to FIG. 1 and 2, it can be seen in overview that the swing brake of this invention includes a support 1, containing brake pad 2, and which is connected to pivot member 3 by link members 4. Referring to FIGS. 4 and 5, it can be seen that the support is a "U" shaped member having a first arm 5, a second arm 6, and a transverse member 7, of tapered configuration, containing extension 8. The support arms have opposing holes 9 to accommodate axle 10 of rear wheel 11 and opposing holes 12 attached to link members 4. The link members are attached to pivot member 3 and support 1 through points 13 and 14. The pivot member 3 embodies a back frame 17 having a first arm 15, a second arm 16 containing roller 18. The pivot member 3 is hinged to the rear of the chassis 19 at point 20 through opposing holes 21 and contains spring 22 having ends 23 anchored in chassis 19. The back 24 of spring 22 is contained by tabs 25 against back frame 17 of pivot member 3.

Returning to FIGS. 1 and 2, it can be seen that the brake pad 2 attached to support 1, is swung up between the rear wheel 11 and wheel 26 by spring 22 in the open position of the swing brake so as to ride free over the skating surface 27. As will be explained further in the "method of use" section, the braking of the swing brake, shown in FIG. 2, is activated when the skater lifts the front end of the skate which action brings the roller 18, contained by a bolt in opposing holes 33 in the tapered end of pivot member 3, into contact with the skating surface. The tilting of the skate will force the roller 18 rearwards while turning the pivot member on its points of attachments 20 to the chassis 19. This in turn will swing support 1 and brake pad 2 downward onto the skating surface 27. At this point, the forward motion of the skates will cause the support 1 and brake pad 2 to swing underneath the rear wheel 11, and come to the full braking position against chassis 19 by stops 28 while the pivot member extends further rearwards against the tension of spring 22. At the same time, the skater lowers the front wheel down onto the skating surface to level the skate. This braking procedure lifts the rear wheel 11 of the skate off the skating surface 27 to bring the skate to a stop with the front wheel in full contact with the ground. In this way, the required braking force of the brake pad against the skating surface is provided by the weight of the skater as adjusted by the skater's forward or rearward posture.

In the preferred embodiment of the invention, the brake pad 2, made from materials of various frictional qualities, is attached to a back plate 29 containing tabs 30 and clips 31. In this way, the brake pad may be fitted to support 1 by slipping the tabs 30 over the top surface of extension 8 of transverse member 7 and then snapping clips 31 into place above the the top surface of the tapered back end of transverse member 7. The brake pad may be removed by unclipping the clips 31 which task is facilitated by prying a pin object against tabs 32 in support arms 5 and 6.

Materials suitable for producing this embodiment of the swing brake include steel for the support and pivot member and high density synthetic rubber compound or other frictional substances molded, sprayed or bonded to the brake back plate which may preferably be made of steel material. The roller may be made from the same material used for the wheels of the skate.

Finally, although the swing brake as shown discloses a certain arrangement of spring and linkages, it should be understood that other types of linkages and springs may be used for pivotal arrangements of the brake pad and its attachment.

METHOD OF USE

Figure 14:
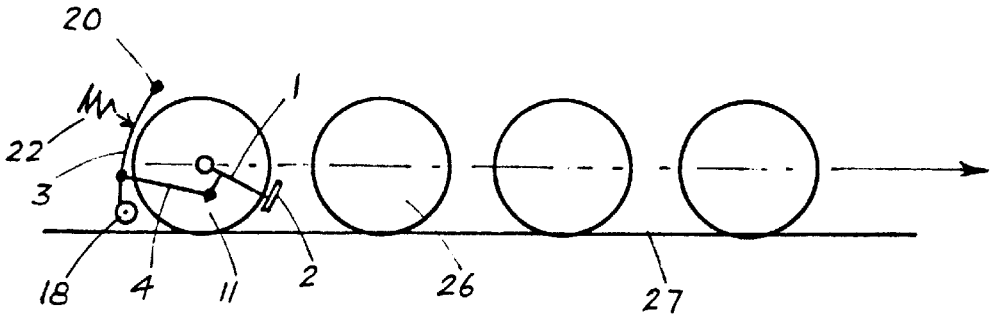
FIG. 14 is a schematic view showing the swing brake of this invention in an open position

The method of use of the swing brake of this invention includes a pivotable brake pad to be activated for stopping the skate by movement of the skater's foot. As shown in FIG. 14, in the open position of the swing brake, the support arm 1 and brake pad 2 is swung up over the skating surface 27 between the rear wheel 11 and wheel 26 and held in that position by spring 22 acting upon pivot member 3. In this skating mode, the roller 18 is held in close proximity to the skating surface and rear wheel.

Figure 15:
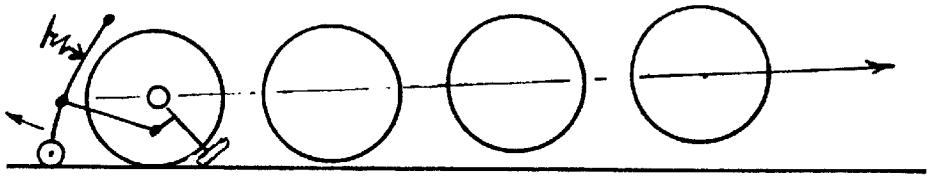
FIG. 15 is a schematic view showing the swing brake of this invention in a brake starting position.
Figure 16:
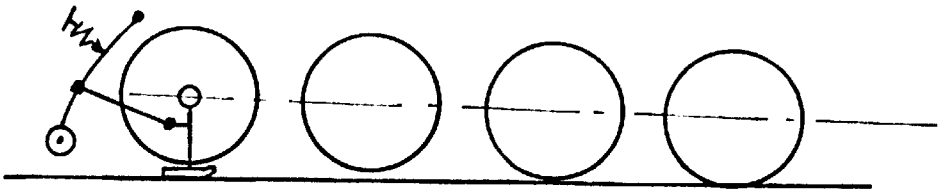
FIG. 16 is a schematic view showing the swing brake of this invention in a fill braking position.
Figure 17:
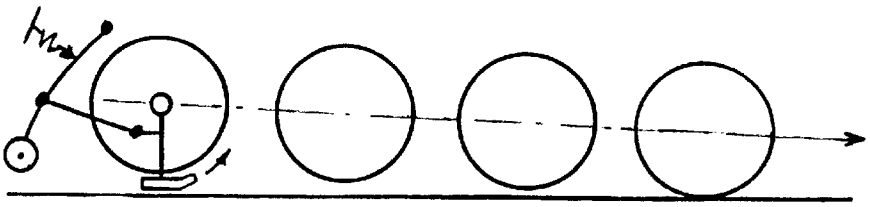
FIG. 17 is a schematic view showing the swing brake in a brake release position.

When braking is desired, the skater raises the front wheel of the skate so as to bring the roller 18, contained by pivot member 3, into contact with the skating surface 27, as shown in FIG. 15. and which action forces the roller 18 and pivot member 3 to swing rearwards. As a consequence and by linkage member 4, the support 1 will swing brake pad 2 down onto the skating surface 27. The movement of the skate and the further rearward swing of the pivot member will then push the brake pad underneath the rear wheel to its full braking position while the skater brings the front wheel of the skate down onto the skating surface, as shown in FIG. 16. Accordingly, the skater will be standing on the brake pad with full front wheel ground contact and where the braking force, applied onto the skating surface, will be proportionate to the weight of the skater. The brake pad is returned to its open position by spring 22 when the rear wheel 11 of the skate is lifted so as to disengage brake pad 2 from the skating surface as shown in FIG. 17.

The method of this invention further includes the option of using two brakes, one on each skate, and the possibility to retrofitting the swing brake to an existing skate.

In summary, the swing brake of this invention is triggered by the skater's foot, uses a brake pad underneath the rear wheel on the skating surface to generate stopping force while the skates remain level, has an effective braking area in contact with the skating surface, provides effortless braking force onto the skating surface by the disposition of the weight of the skater over the brake pad, can be fitted to both skates, provides snap-on brake pad replacements for any purpose, and is of light weight with little protrision.

It is to be noted, that while essentially portraying the subject roller skate swing brake, the enclosed drawing should not limit the scope of the invention in general.

What is claimed is:

1. An in-line skate for use on a skating surface and a brake assembly, comprising:

a frame, a plurality of wheels rotatably mounted on axles supported by the frame, and a shoe attached to the frame;

a pivot member having a back portion and laterally spaced first and second arms with ends which are pivotally connected to a rearward end of the frame;

first and second link members having upper ends being pivotally connected to respective first and second arms of the pivot member;

a U-shaped support having laterally spaced first and second legs, the first and second legs having first ends which are interconnected by a transverse member and second ends which are pivotally connected to respective lower ends of the first and second link members, the first and second legs being pivotally connected to an axle supporting a rearmost wheel with the rearmost wheel positioned therebetween; and a brake pad attached to an outer surface of the transverse member of the U-shaped support, the U-shaped support being biased to a non-braking position with the brake pad raised above the skating surface and positioned between the rearmost wheel and an adjacent wheel, the brake pad being movable towards a braking position with the brake pad positioned between a forward facing surface of the rearmost wheel and the skating surface by rearward pivoting of the pivot member upon engagement with the skating surface and the brake pad being configured for moving into a full braking position upon engagement of the brake pad with the skating surface during forward motion of the roller skate over the skating surface and upon further rearward pivoting of the pivot member, the first and second legs of the U-shaped support being positioned vertically with the brake pad positioned between a lowermost surface of the rearmost wheel and the skating surface while in the full braking position, the brake pad being maintained in the the full braking position by the weight of the skater upon the rearmost wheel and being movable to the non-braking position upon disengagement of the brake pad from the skating surface.

2. The in-line skate of claim 1, wherein the U-shaped support includes stop members adjacent the second ends of the first and second legs which are engagable with rearwards ends of the frame for limiting pivotal movement of the U-shaped support while in the full braking position.

3. The in-line skate of claim 1, wherein the transverse member is engagable with the frame for limiting pivotal movement of the U-shaped support while in the non-braking position.

4. The in-line skate of claim 1, wherein the U-shaped support is biased to the non-braking position by a torsion spring connected to the U-shaped pivot member and the frame.

5. The in-line skate of claim 1, wherein the pivot member contains a roller.

6. The in-line skate of claim 5, wherein the pivot member is tapered to the rim width of the rearmost wheel.

7. The in-line skate of claim 1, wherein the brake pad is molded to the transverse member of the U-shaped support.

8. The in-line skate of claim 1, wherein the brake pad contains a back plate adaptable to the transverse member.

9. The in-line skate of claim 8, wherein the back plate contains fastening clips.

10. The in-line skate of claim 1, wherein the transverse member and the brake pad have bent tapered extensions.

11. The in-line skate of claim 10, wherein the transverse member and the brake pad are tapered from the side of the bent tapered extensions.

* * * * *